United States Patent [19]

Anderson

[11] 3,955,414

[45] May 11, 1976

[54] CONTACT INSERTION APPARATUS

[75] Inventor: Randy H. Anderson, Brea, Calif.

[73] Assignee: International Telephone and Telegraph Corporation, New York, N.Y.

[22] Filed: Feb. 18, 1975

[21] Appl. No.: 550,360

[52] U.S. Cl. ..... 29/203 B; 29/206 R

[51] Int. Cl.[2] ..... H01R 43/00

[58] Field of Search ..... 29/620, 630 R, 630 A, 29/206, 203 P, 203 H, 203 HM, 203 HC, 203 B, 235, 629

[56] References Cited

UNITED STATES PATENTS

| | | | |
|---|---|---|---|
| 3,222,766 | 12/1965 | Camargo | 29/206 X |
| 3,325,884 | 6/1967 | Blight et al. | 29/203 H |
| 3,451,117 | 6/1969 | Cameron | 29/206 X |
| 3,624,887 | 12/1971 | Hilbert | 29/203 H |
| 3,672,024 | 6/1972 | Barr | 29/203 H |

FOREIGN PATENTS OR APPLICATIONS

| | | | |
|---|---|---|---|
| 561,262 | 8/1958 | Canada | 29/206 |

*Primary Examiner*—C. W. Lanham
*Assistant Examiner*—James R. Duzan
*Attorney, Agent, or Firm*—Thomas L. Peterson

[57] ABSTRACT

A method and apparatus for inserting an electrical contact into a bore in an electrical connector insulator. A sleeve with a slidable pin therein extending beyond the forward end of the sleeve are pushed together through the bore. The pin is then retracted and the contact is inserted into the sleeve. The sleeve is thereafter retracted leaving the pin in the bore.

1 Claim, 4 Drawing Figures

CONTACT INSERTION APPARATUS

BACKGROUND OF THE INVENTION

The present invention relates generally to an electrical connector and, more specifically, to a method and apparatus for inserting an electrical contact into a bore in an insulator of an electrical connector.

An electrical connector normally utilizes an insulator body in which the electrical contacts are mounted. In some connectors the body is formed of a resilient material. The contacts are mounted within bores extending through the body. In addition, sometimes the contacts are retained in the bores in the body by means of an integral resilient flange which extends radially inwardly from the wall of the bore, and engages within a cooperating groove formed within the contact. Also, it is conventional practice to provide annular sealing ribs in the wall of the bore for making sealing engagement with the conductor which is connected to the contact and extends through the rear of the bore. The insertion of contacts directly into the bores in the insulator sometimes causes damage to either the contact retention flange or the sealing ribs. Also, insertion of the contacts is slow and often difficult. These problems are most serious when the contact is a socket contact having a blunt forward end of relatively large cross-section. It is the object of the present invention to provide an improved method and apparatus for quickly and easily inserting contacts into a bore formed in the insulator of an electrical connector without damaging any sealing or retention ribs formed on the wall of the bore.

SUMMARY OF THE INVENTION

According to the principal aspect of the present invention, there is provided a method and apparatus for inserting an electrical contact into a bore in an insulator of an electrical connector. A sleeve is provided with a slidable pin therein having a pointed end which extends beyond the forward end of the sleeve. The sleeve and pin are pushed together through the bore in the insulator. The pin is then retracted in the sleeve and the contact is inserted into the sleeve from the forward end thereof. Thereafter, the sleeve is retracted in the bore leaving the contact in the bore. Since the pointed forward end of the pin leads the sleeve as they are pushed through the bore, no damage to sealing or retention ribs formed on the wall of the bore occurs. Furthermore, the contact is easily slid into the bore since it is inserted directly into the sleeve positioned therein. Thus, the contact is easily and rapidly inserted into the bore in the insulator without causing any damage to the insulator.

DESCRIPTION OF THE PREFERRED EMBODIMENT

Figure 1:
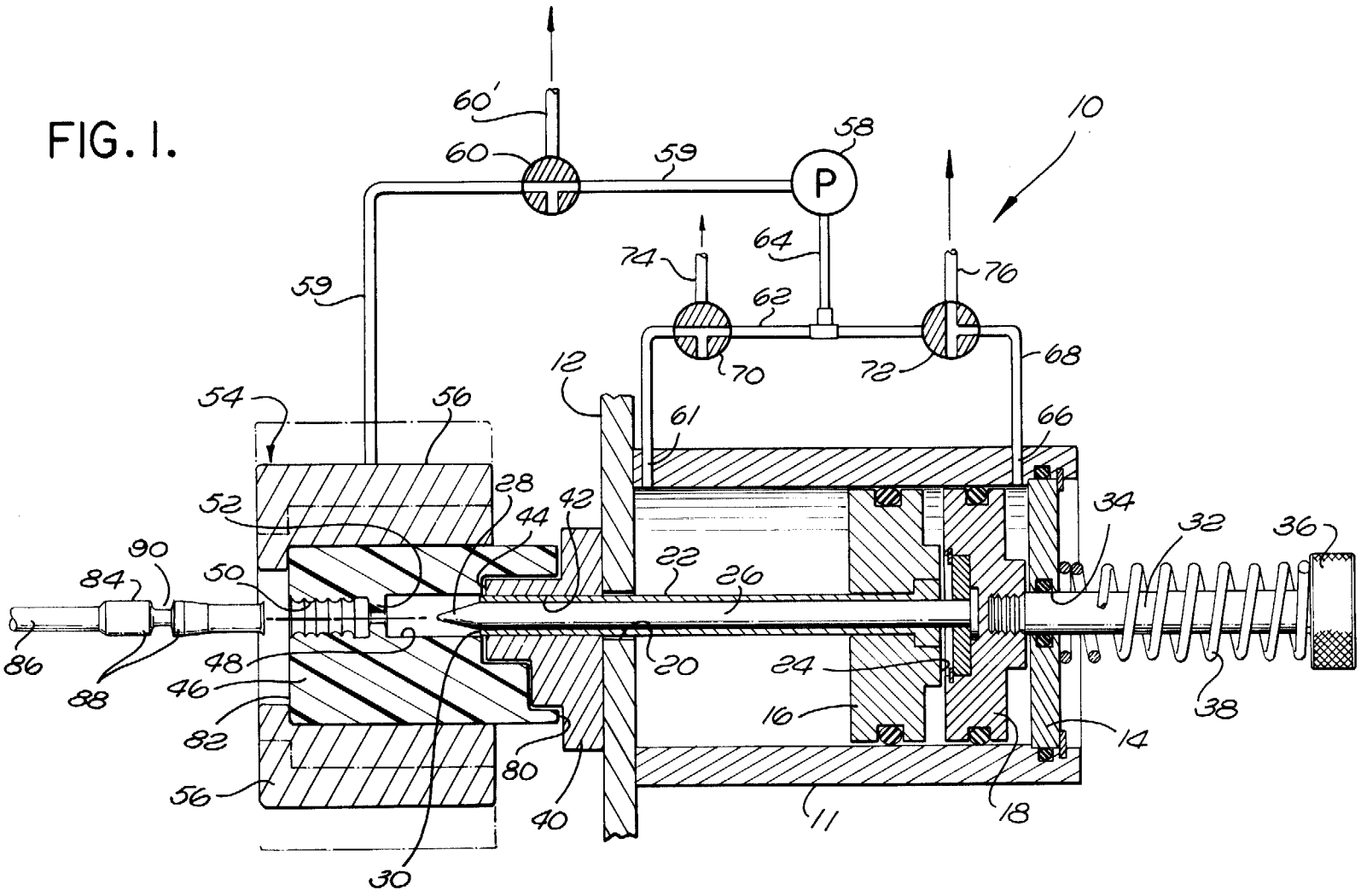
FIG. 1 is a schematic illustration, in partial section, of the apparatus of the present invention with the pin and sleeve thereof in their initial fully retracted position and the clamping mechanism shown in a closed position holding a connector insulator in fixed position in the apparatus.

Referring now to the drawings in detail, the apparatus of the present invention, generally designated 10, comprises a cylinder 11 having a front wall 12 and a rear wall 14. A pair of pistons 16 and 18 are slidable within the cylinder. An opening 20 is provided in the front wall 12 coaxial with the pistons 16 and 18. A cylindrical sleeve 22 fixed to the piston 16 extends through the opening 20. The sleeve extends to the rear wall 24 of the piston 16 providing a passage through the piston. A pin 26 is fixed to the piston 18 and extends forwardly through the sleeve 22 in sliding relationship therewith. The forward pointed end 28 of the pin 26 extends beyond the forward end 30 of the sleeve 22 when the pistons 16 and 18 are positioned adjacent to the rear wall 14 of the cylinder as viewed in FIG. 1.

A shaft 32 fixed to the piston 18 extends through a central opening 34 in the rear wall 14 of the cylinder. The shaft terminates in a head 36. A coil spring 38 surrounds the shaft 32 and extends from the rear wall 14 to the head 36, thereby biasing the piston 18 in the rightward direction as viewed in FIG. 1.

A guide member 40 is fixed to the front wall 12 of the cylinder 11. A passage 42 extends through the guide member 40 aligned with the opening 20. The passage 42 is dimensioned to slidably receive the sleeve 22. It is noted that when the pistons 16 and 18 are in their fully retracted position as illustrated in FIG. 1, the forward ends of the pin and sleeve extend a short distance in front of the front face 44 of the guide member 40.

A cylindrical connector insulator 46 is mounted on the guide member 40. The insulator is typically formed of a resilient material, such as rubber or plastic. A bore 48 extends through the insulator 46. The guide member 40 positions the insulator so that the bore 48 is coaxial with the pin and sleeve. The wall of the bore 48 in the insulator 46 is formed with a plurality of annular sealing ribs 50 and an integral inwardly extending contact retention flange 52.

A clamping mechanism, generally designated 54, is provided for holding the insulator 42 in fixed position on the guide 40 with the bore 48 therein aligned with the pin and sleeve in the cylinder 11. Such clamping mechanism is shown schematically as including a pair of semi-cylindrical plates 56 above and below the insulator and adapted to be moved from the dotted line position illustrated in FIG. 1 remote from the insulator to the full line position wherein the plates firmly hold the insulator in position.

To operate the clamping mechanism 54 and to shift the pistons 16 and 18, there is provided a source of air pressure 58. The source 58 is connected to the clamping mechanism 54 by a line 59 having a two-way valve 60 therein. The valve is connected to an air vent 60'. The air pressure source 58 is also connected to a port 61 in cylinder 11 adjacent the forward front wall 12 of the cylinder by lines 62 and 64, and is connected to a second port 66 adjacent to the rear wall 14 of the cylinder by the line 64 and an additional line 68. Two-way valves 70 and 72 are provided in the lines 62 and 68, respectively. Air vents 74 and 76 are associated with the valves 70 and 72, respectively.

Figure 2:
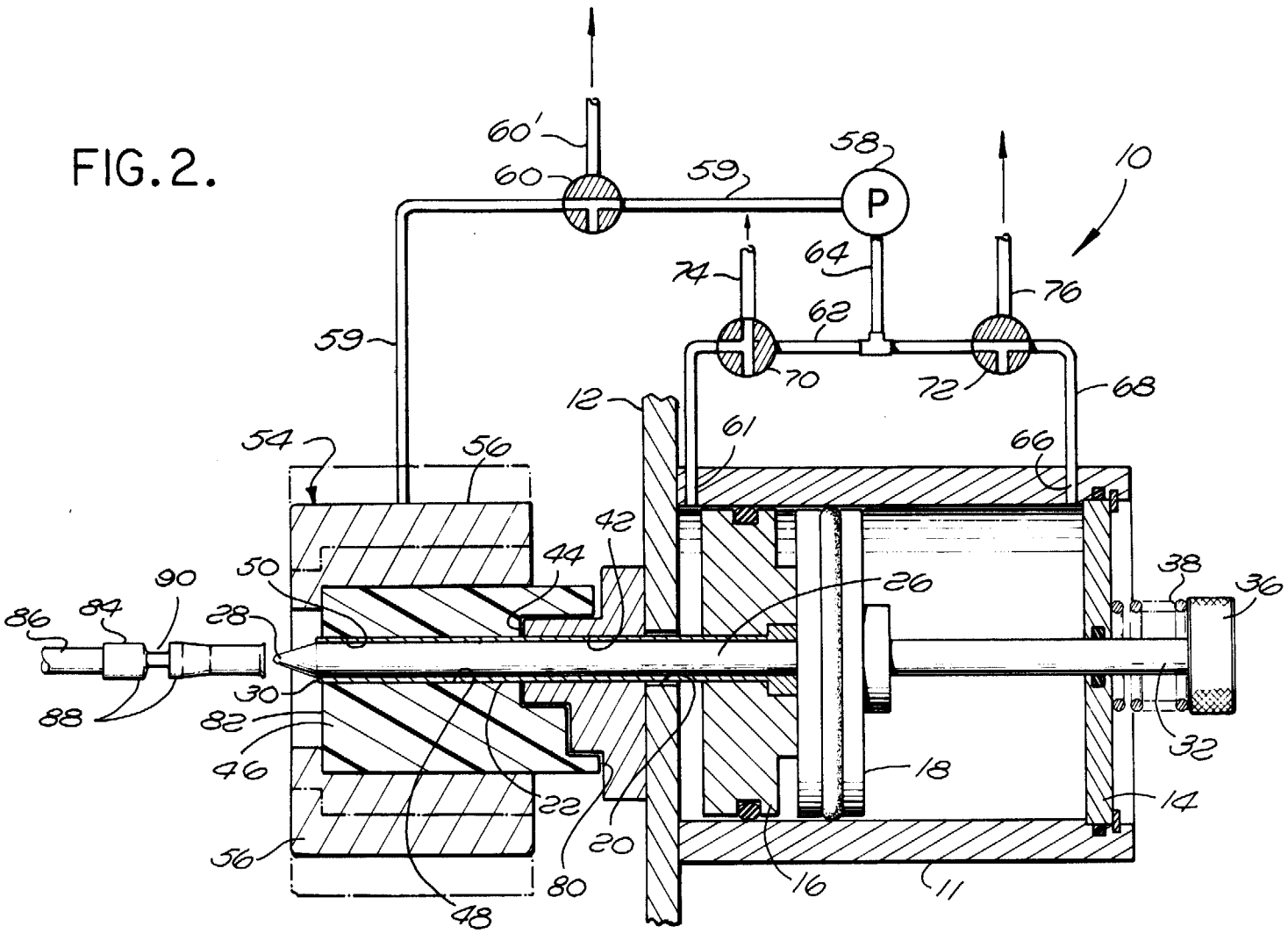
FIG. 2 is a schematic illustration similar to FIG. 1 showing the pin and sleeve pushed through the bore in the insulator.
Figure 4:
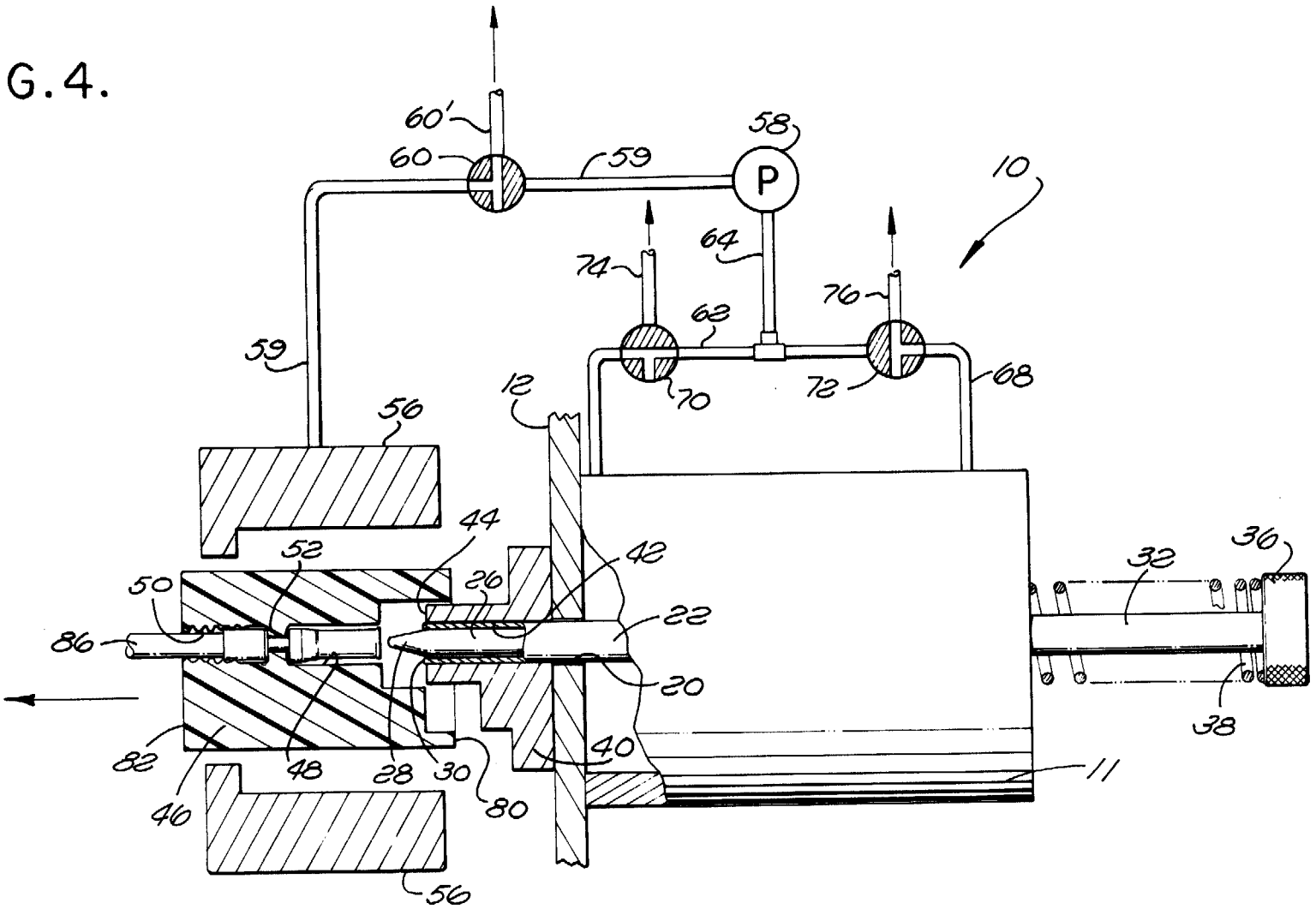
FIG. 4 is a fragmentary sectional view of the forward portion of the apparatus illustrated in FIG. 1 showing the pin and sleeve both retracted in the insulator bore, leaving the contact in the bore, and with the clamping mechanism for the insulator shown in its open position.

The operation of the apparatus 10 is as follows. With the valve 60 in the position illustrated in FIG. 4, the clamping mechanism 54 is in an open position as shown in FIG. 4 and in dotted lines in FIG. 1. When the clamping mechanism is in such open position, the insulator 46 is mounted over the guide 40 with the bore 48 therein aligned with the sleeve 22 and pin 26. Since the pin and sleeve extend a short distance beyond the front face of the guide into the bore 48, they also serve to properly locate the insulator. The valve 60 is then opened allowing air pressure from the source 58 to shift the clamping parts 56 toward each other to firmly hold the insulator in position, is shown in full lines in FIG. 1. Thereafter, the valves 70 and 72 are shifted to the position illustrated in FIG. 2 so that air pressure will be applied through the lines 64 and 68 to the port 66, and thus to the right side of the piston 18, causing the pistons 16 and 18 to shift to the left end of the cylinder 10 as seen in FIG. 2. It is noted that the valve 70 in FIG. 2 vents the left side of the cylinder to atmosphere through the vent 74. Shifting of the pistons 16 and 18 toward the front wall 12 of the cylinder causes the pin 26 and sleeve 22 to pass through the bore 48 in insulator 46 from the front face 80 to the rear face 82 of the insulator. Since the forward pointed end 28 of the pin extends beyond the end 30 of the sleeve 22, the pin and sleeve may be easily pushed through the bore 48 in the insulator without damaging the sealing ribs 50 or retention flange 52 formed on the wall of the bore.

Figure 3:
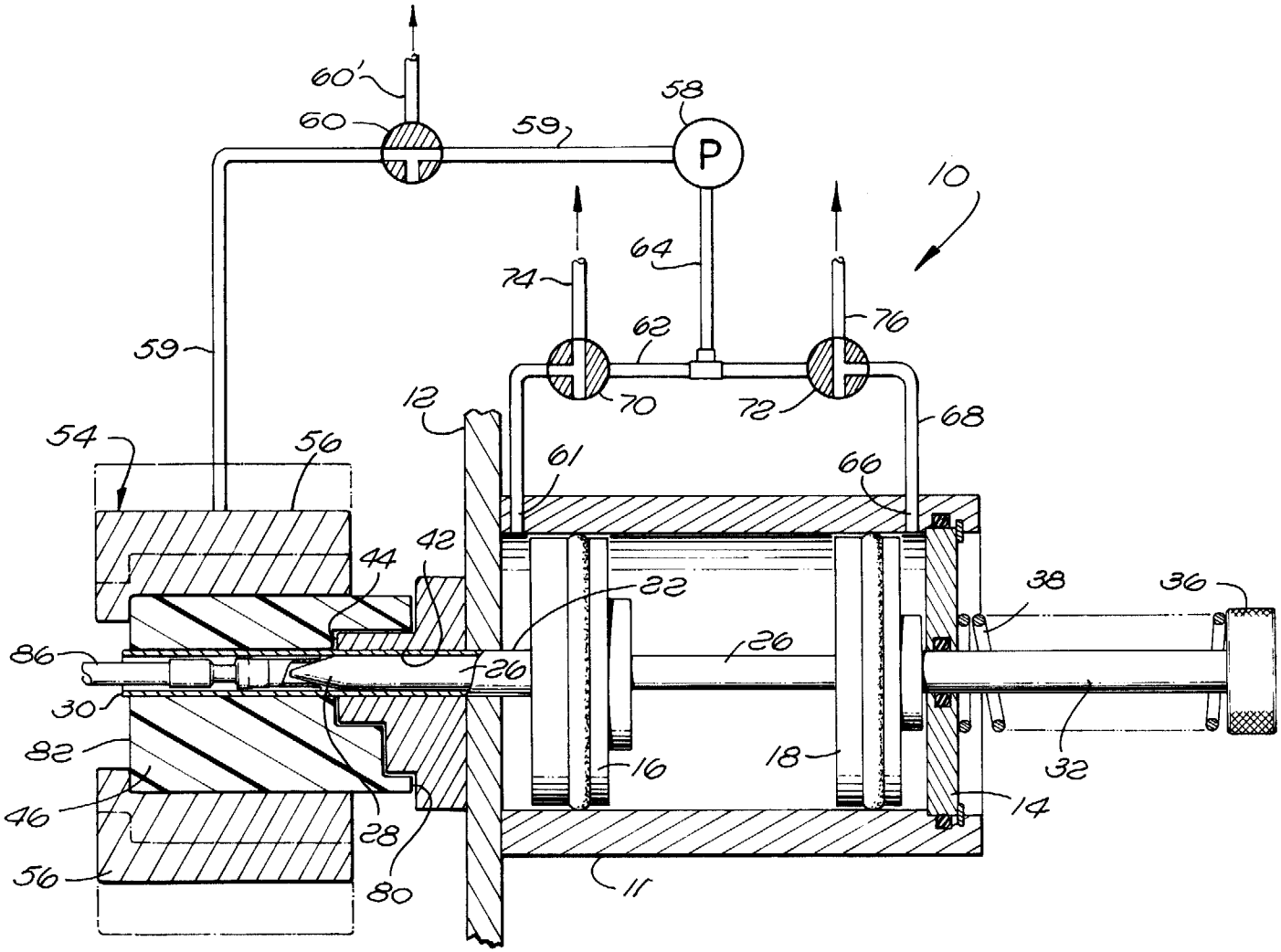
FIG. 3 is a schematic illustration similar to FIG. 1 showing the pin retracted in the sleeve and a contact inserted into the forward end of the sleeve.

Thereafter, the valve 72 is shifted to the position illustrated in FIG. 3 so that both the ports 61 and 66 are vented to atmosphere. Hence, the piston 18 shifts to the right to a position adjacent to the rear wall 14 of the cylinder under the action of the spring 38. Such movement of the piston 18 retracts the pin 26 in the sleeve 22 to a position adjacent to the forward end of the bore 48 in the insulator thus leaving an open space in the forward end of the sleeve. An electrical contact 84, shown as being a socket contact although it could be a pin contact, is then slidably inserted into the open forward end of the sleeve 22. The contact has a diameter less than the internal diameter of the sleeve. The contact is crimped to the bare portion (not shown) of an insulated wire 86. The contact has a pair of axially spaced outwardly extending flanges 88 defining an annular groove 90 therebetween. When the contact is inserted into the sleeve so that its forward end abuts the end of the pin 26, the groove 90 will be aligned with the retention flange 52 on the wall of the bore 48 in the insulator. Thus, the pin functions as a positioning stop for the contact. Normally the contact 84 will be inserted into the sleeve by hand, although this operation could be preformed automatically if desired. The contact is held in position in the sleeve and then the valve 70 is shifted to the position illustrated in FIG. 1 so that air pressure is applied from the source 58 to the left end of the cylinder 11, causing the piston 16 to shift rightward in the cylinder to the position illustrated in FIG. 1, thereby retracting the sleeve 22 in the bore 48, leaving the contact positioned within the bore as seen in FIG. 4. Retracting the sleeve in the bore allows the resilient retention flange 52 on the wall of the bore to expand into the groove 90 in the contact thereby fixedly positioning the contact within the bore. In addition, the sealing ribs 50 will firmly engage the insulated wire 86 to provide a seal therebetween.

The valve 60 is now shifted to the position illustrated in FIG. 4 venting the line 59 to atmosphere through the vent 60' thereby allowing the clamping mechanism 54 to open under the force of a spring or the like, not shown, as illustrated in FIG. 4. Hence, the insulator may be removed from the guide 40, permitting a second insulator to be mounted on the guide for the insertion of a contact thereinto following the sequence of operations first described.

Thus, it is seen that by the present invention there is provided a method and apparatus for easily and rapidly inserting contacts into insulators without causing any damage to the insulator. While the pin 26 and sleeve 22 have been described as being actuated by air operated pistons, it will be appreciated that they could be actuated by hand, if desired. Furthermore, the valve system described herein is given by way of example only. Obviously, any form of valving arrangement may be utilized for actuating the pistons and clamping mechanism 54. For example, the valves 60, 70 and 72 could be incorporated within a single assembly. Other modifications and variations of the invention will be apparent to those skilled in the art.

What is claimed is:

1. An apparatus for facilitating the insertion of an electrical contact into a bore in an electrical connector insulator comprising:

a cylinder having front and rear walls;

front and rear pistons slidable in said cylinder between said front and rear walls;

an opening in said front wall;

means for mounting said insulator adjacent to said front wall with said bore therein aligned with said opening;

a sleeve connected to said front piston and extending forwardly through said opening in sliding relationship therewith;

a pin slidable in said sleeve, said pin having a forward pointed end, the rear end of said pin being connected to said rear piston;

spring means biasing said rear piston rearwardly toward said rear wall;

pneumatic control means for shifting said pistons rearwardly in said cylinder toward said rear wall to a first position wherein said forward pointed end of said pin projects forwardly of the forward end of said sleeve;

said pneumatic control means shifting said pistons together forwardly in said cylinder toward said front wall to a second position to push said sleeve and pin through said insulator bore;

said pneumatic control means and said spring means cooperating to cause said rear piston to shift rearwardly relative to said front piston to a third position, in said third position of said pistons said forward pointed end of said pin being retracted rearwardly in said sleeve to be spaced behind the forward end of said sleeve allowing a contact to be inserted thereinto; and said pneumatic control means shifting said front piston rearwardly in said cylinder to return said front piston to its said first position to withdraw said sleeve from said bore bearing said contact in said bore.

* * * * *